US008992157B2

(12) United States Patent
Gilmore

(10) Patent No.: US 8,992,157 B2
(45) Date of Patent: Mar. 31, 2015

(54) HYDRAULIC CYLINDER WITH GUIDE BUSHING FOR A SLIDING DIPPER HANDLE OF A POWER SHOVEL

(75) Inventor: Carl D. Gilmore, South Milwaukee, WI (US)

(73) Assignee: Caterpillar Global Mining LLC, Oak Creek, WI (US)

( * ) Notice: Subject to any disclaimer, the term of this patent is extended or adjusted under 35 U.S.C. 154(b) by 748 days.

(21) Appl. No.: 13/318,599

(22) PCT Filed: May 28, 2009

(86) PCT No.: PCT/US2009/045422

§ 371 (c)(1),
(2), (4) Date: Nov. 2, 2011

(87) PCT Pub. No.: WO2010/138122

PCT Pub. Date: Dec. 2, 2010

(65) Prior Publication Data

US 2012/0051877 A1 Mar. 1, 2012

(51) Int. Cl.
*E02F 3/30* (2006.01)

(52) U.S. Cl.
CPC ..... *E02F 3/304* (2013.01); *E02F 3/306* (2013.01)
USPC ..... 414/690; 384/590

(58) Field of Classification Search
CPC ..... E02F 3/304; E02F 3/306
USPC ..... 414/690; 384/590
See application file for complete search history.

(56) References Cited

U.S. PATENT DOCUMENTS

| | | | | |
|---|---|---|---|---|
| 3,353,686 | A | 11/1967 | Cowan | |
| 3,375,943 | A | 4/1968 | Learmont et al. | |
| 3,522,977 | A | 8/1970 | Lee et al. | |
| 4,236,863 | A * | 12/1980 | Baron | 414/687 |

FOREIGN PATENT DOCUMENTS

| | | |
|---|---|---|
| EP | 0 718 444 | 6/1996 |
| EP | 1 172 324 | 1/2002 |

OTHER PUBLICATIONS

International Search Report and Written Opinion regarding International Application No. PCT/US2009/045422, mail date Oct. 9, 2009, 17 pages.

* cited by examiner

*Primary Examiner* — Scott Lowe
(74) *Attorney, Agent, or Firm* — Foley & Lardner LLP

(57) ABSTRACT

A crowd assembly (30) for a power shovel (10) includes a saddle block (34) adapted for pivotal connection to the shovel boom (24). A tubular dipper handle (32) is slideably supported by the saddle block. A hydraulic actuator (50) has a cylinder (52) and a piston rod (54) that is outwardly extendable from one end of the cylinder. One of the cylinder or the piston rod is fixed to the dipper handle and the other one is attached to the saddle block. The cylinder and the piston rod are within the tubular dipper handle which is able to slide longitudinally over the cylinder. A guide bushing (70) extends around the one end of the cylinder and engages an interior surface of the dipper handle. The guide bushing thereby supports that end of the cylinder and inhibits hydraulic actuator from deflecting within the dipper handle when the piston rod is extended from the cylinder.

19 Claims, 2 Drawing Sheets

HYDRAULIC CYLINDER WITH GUIDE BUSHING FOR A SLIDING DIPPER HANDLE OF A POWER SHOVEL

CROSS-REFERENCE TO RELATED APPLICATIONS

The present application is a U.S. national stage of and claims priority to and the benefit of International Application No. PCT/US2009/045422, entitled "Hydraulic Cylinder With Guide Bushing For A Sliding Dipper Handle Of A Power Shovel," filed May 28, 2009, which is incorporated herein by reference in its entirety.

STATEMENT REGARDING FEDERALLY SPONSORED RESEARCH OR DEVELOPMENT

Not Applicable

BACKGROUND OF THE INVENTION

1. Field of the Invention

This invention relates to power shovels, and more particularly to hydraulic mechanisms for operating a sliding dipper handle of the mining shovel.

2. Description of the Related Art

A typical mining power shovel includes a turntable mounted on a crawler truck, and supporting an A-frame and a cab. A boom, extending from the turntable, has an upper end supported by the A-frame and pivotally supporting a dipper handle that pivots in a vertical plane. A dipper fixed to a distal end of the dipper handle is raised and lowered by a hoist cable which extends over a sheave at the top of the boom and down to a padlock on the dipper. The hoist cable provides for the vertical, raising and lowering, movement of the dipper. A crowd assembly extends and retracts the dipper handle to provide the horizontal component, or crowd, of the dipper's movement.

Many different crowd assemblies have been developed over the years. Rack and pinion crowd assemblies include a rack fixed to the dipper handle which engages a rotatably driven pinion, or gear, mounted in the boom. Rope crowd assemblies include metal ropes that are wound and unwound from a crowd drum to extend and retract the dipper handle.

Also known in the art are hydraulic crowd assemblies, which utilize a large double-acting hydraulic actuator. U.S. Pat. No. 3,425,574 discloses a hydraulic crowd assembly that has a saddle block comprising a tubular support frame pivotally coupled by a yoke to the boom. A round tubular dipper handle, attached to the dipper, slides into and out of the support frame as the dipper moves with respect to the boom. That sliding motion is driven by a double acting hydraulic actuator comprising a cylinder within which a piston moves in response to pressurized hydraulic fluid being fed into the cylinder. A piston rod, connected to the piston, projects outward through an aperture at one end of the cylinder. The other end of the cylinder is attached to an extremity of the support frame that is remote from the saddle block and the exterior end of the piston rod is connected to a section of the dipper handle that is remote from the support frame. Thus the hydraulic actuator is supported at one end by connection of the cylinder to the support frame and at the other end by attachment of the piston rod to the dipper handle. Except at those ends, there are no supports between the either the hydraulic actuator and either the dipper handle or the saddle block.

Because hydraulic actuator of the dipper handle is very long, especially when the piston rod is extended significantly from the cylinder, and because the crowd assembly and its hydraulic actuator often extend substantially horizontal, the combination of the cylinder and piston rod can deflect or sag due to gravity. As a result, the rod frequently passes off center through the aperture in the cylinder, resulting in a smaller gap in the cylinder aperture above the rod than beneath the rod. In fact, the upper part of the piston rod can contact the cylinder, thereby scoring the surfaces sliding on each other. Over time, this deflection and the piston rod scoring can damage the aperture seal between the piston rod and the cylinder, resulting in leakage of hydraulic oil.

SUMMARY OF THE INVENTION

A crowd assembly includes a saddle block adapted for pivotal connection to a boom and for supporting a tubular dipper handle in a manner that allows the dipper handle to slide relative to the saddle block.

A hydraulic actuator has a cylinder and a piston rod that is extendable from one end of the cylinder. Either the cylinder or the piston rod is fixed to the dipper handle and the other one of the cylinder and the piston rod is stationary relative to the saddle block. The cylinder and the piston rod are received within the dipper handle, thereby enabling the dipper handle to slide longitudinally over the cylinder.

A guide bushing is affixed to the cylinder adjacent the one end and slideably engages an interior surface of the dipper handle. Thus the guide bushing supports that one end of the cylinder and maintains a position of the cylinder relative to the dipper handle as that latter component slides over the cylinder. The guide bushing prevents the hydraulic actuator from deflecting or sagging within the dipper handle as the piston rod is extended from the cylinder.

That support also maintains the piston rod substantially centered in an aperture of the cylinder thereby minimizing a likelihood of the piston rod contacting a wall of that aperture and enhancing the ability of a seal in that aperture to resist pressure of the fluid within the cylinder.

DETAILED DESCRIPTION OF THE PREFERRED EMBODIMENTS

Figure 1:
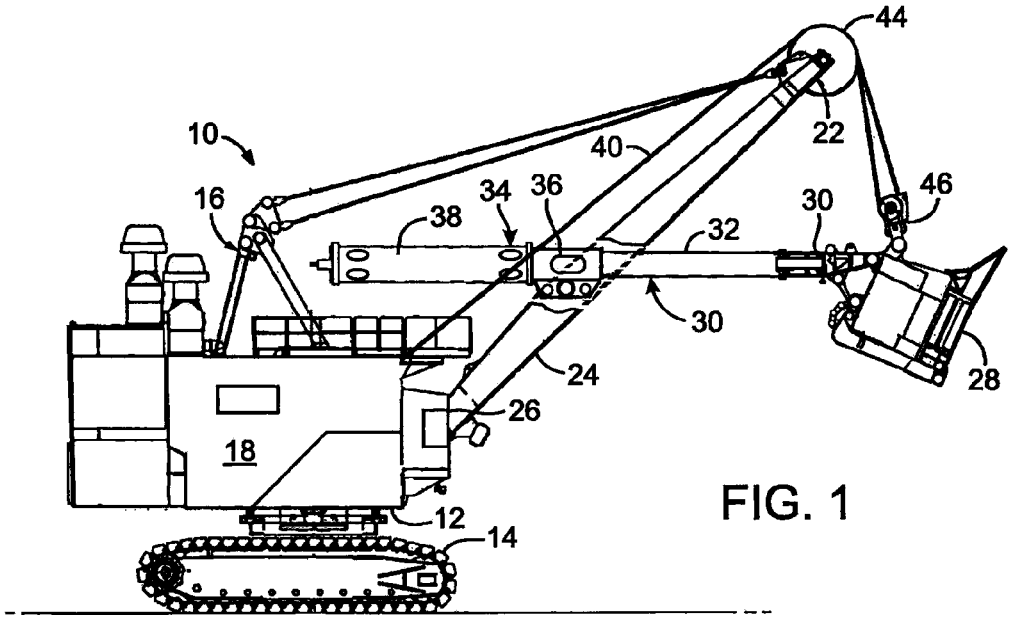
FIG. 1 is a side elevational view of a power shovel that utilizes a crowd assembly incorporating the present invention.

Referring to FIG. 1, a mining power shovel 10 includes a turntable 12 mounted on a crawler truck 14, and supporting an A-frame 16 and a cab 18. The cab 18 houses a power unit, control equipment, and the operator. The control equipment includes an electrical control system that operates the power shovel components in response to inputs from the operator and automatic devices, such as limit switches, pressure switches, and temperature switches, and the like. The operator can provide inputs from within the cab 18 through manually operable devices, such as a joystick, lever, foot pedals, rocker switches, computer keyboard, and touch pads, for example.

The A-frame 16 supports a top end 22 of a boom 24 and a bottom end 26 of the boom is supported by the turntable 12. With additional reference to FIG. 2, a dipper 28 is mounted on the front end 29 of crowd assembly 30 that comprises a dipper handle 32, a saddle block 34 and a double acting hydraulic actuator 50. The dipper handle 32 is mounted at one end to the dipper 28 and is slideably supported in the saddle block 34 pivotally attached to the boom 24. The saddle block 34 includes a yoke 36 and a tubular support frame 38 that projects rearwardly from the yoke and encloses the rear end of the dipper handle 32. The saddle block yoke 36 is pivotally mounted to the boom 24, so as to rotate in a vertical plane. A hoist cable 40 extends upward from a powered hoist drum (not visible) within the cab 18, over a sheave 44 at the top end 22 of the boom 24 and down to a padlock 46 on the dipper 28. The hoist cable 40 provides for the vertical, raising and lowering, movement of the dipper 28.

The double acting hydraulic actuator 50 of the crowd assembly 30 includes a cylinder 52 and an extendible piston rod 54 that are enclosed in the support frame 38 and the dipper handle 32. The hydraulic actuator 50 provides the horizontal component, or crowd, of the dipper's movement. In the embodiment disclosed herein, the cylinder 52 is fixed relative to the saddle block 34, and the piston rod 54 is fixed relative to the dipper handle 32. As a result, extension of the piston rod 54 from a retracted position in the cylinder 52 urges the dipper handle 32 telescopically from the support frame 38. Conversely, retraction of the piston rod 54 into the cylinder 52 urges the dipper handle 32 from the extended position toward the retracted position. Of course, the cylinder 52 can be fixed relative to the dipper handle 32, and the piston rod 54 can be fixed relative to the saddle block 34 without departing from the scope of the invention.

Figure 2:
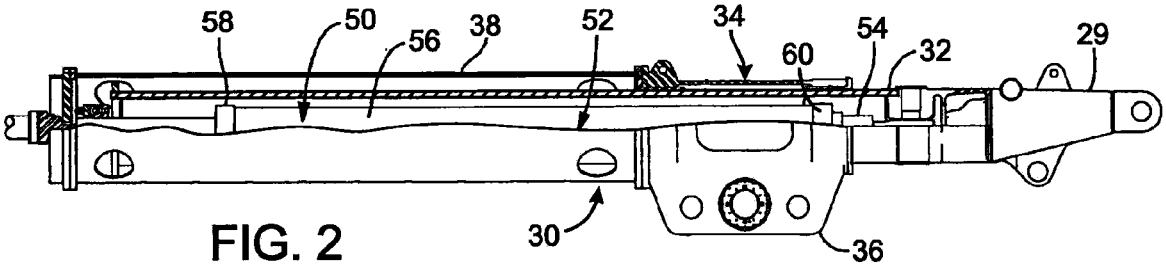
FIG. 2 is a side elevational view, partially in section, of the dipper handle and saddle block of the power shovel of FIG. 1.
Figure 3:
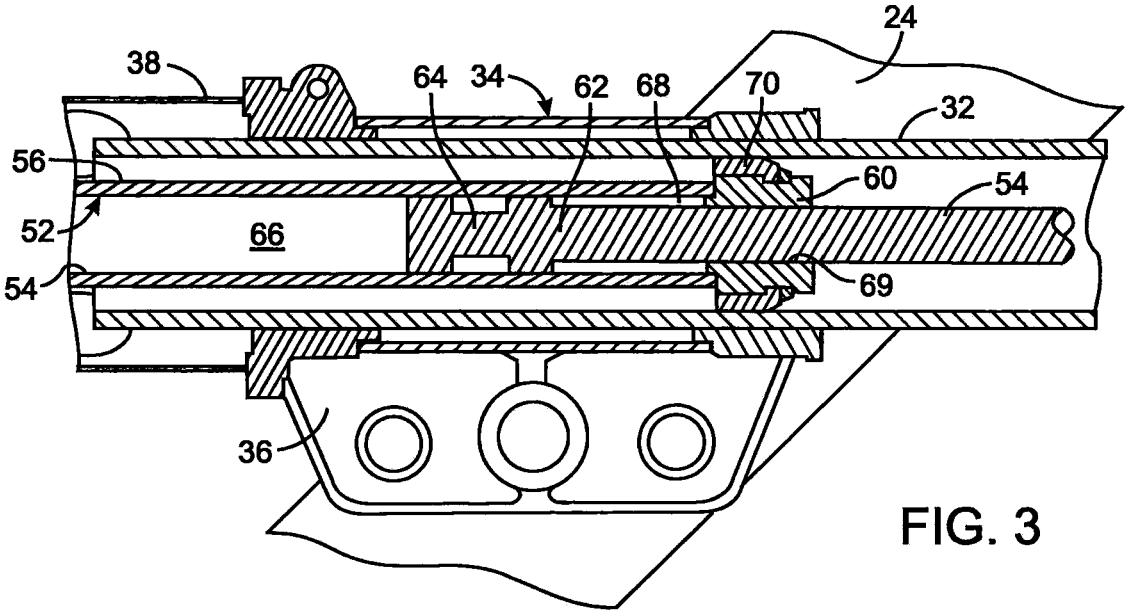
FIG. 3 is a longitudinal cross sectional view through the yoke of the saddle block showing a portion of the dipper handle therein.

The double-acting hydraulic actuator 50, shown in greater detail in FIGS. 2 and 3, includes the hollow cylinder 52 having a tubular shell 56, a closed end 58, and opposite open end that is closed by a head 60 welded to the shell. An inner end 62 of the piston rod 54 extends through an aperture 69 in the cylinder head 60 into the tubular shell 56. A piston 64, fixed to the inner end 62 of the piston rod 54, contacts the interior surface of the cylinder shell 56, thereby defining a cap or bottom end chamber 66 and a rod chamber 68, each having a separate hydraulic fluid port (not shown). By supplying pressurized fluid to one port and draining fluid from the other port, the piston 64 is driven in one of two directions within the cylinder 52, as is well known. That motion of the piston in one direction extends the piston rod 54 from the cylinder 52, while the motion in the opposite direction retracts the piston rod into the cylinder. U.S. Pat. No. 7,174,826 describes a hydraulic system for operating the double-acting hydraulic actuator 50 in this manner.

Because the remote end of the piston rod 54 from the cylinder 52 is fixed to the interior of the dipper handle 32, as the piston rod extends and retracts with respect to the cylinder 52, the dipper handle also extends from and retracts into the support frame 38. Because the dipper handle is tubular, that motion with respect to the support frame also causes the dipper handle 32 to slide longitudinally over the head 60 of the cylinder 52, as specifically shown in FIG. 3.

The hydraulic actuator 50 is supported at its opposite ends, as was the case with previous crowd assemblies. In such previous crowd assemblies, however, the interior surface of the dipper handle was spaced from and did not contact the exterior of the cylinder. Therefore, when the piston rod was extended significantly from the cylinder, the combination of those components tended to deflect or sag due to gravity and other forces when the horizontal crowd assembly was substantially horizontal.

Figure 4:
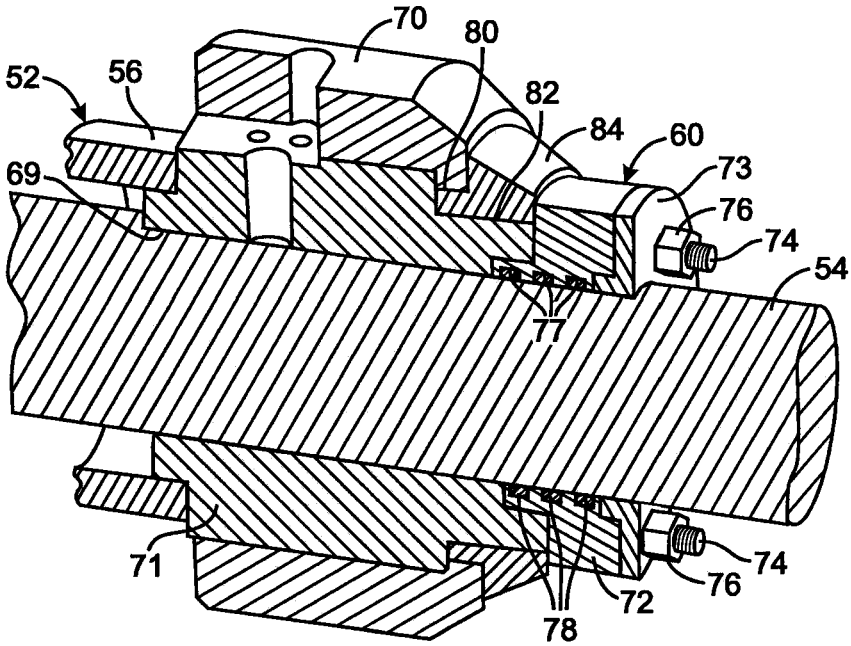
FIG. 4 is a longitudinal cross sectional view through a head end of the hydraulic cylinder with a guide bushing attached thereto.

The present structure prevents that deflection or sagging by placing a guide bushing 70 around the exterior of the cylinder head 60, as shown in FIGS. 3 and 4. The cylinder head 60 is formed by three components 71, 72, and 73 that fit against one another and are held together by a plurality of sets of bolts 74 and nuts 76, only two sets being visible in FIG. 4. A tubular body 71 of the cylinder head 60 is secured to the end of the cylinder shell 56, such as by welding for example, to provide a fluid tight seal. An annular seal carrier 72 is against the body 71 and has a plurality of grooves 77 extending circumferentially on its interior surface. A separate sealing ring 78 is received within each of those grooves 77 to seal a small gap between the cylinder head 60 and the piston rod 54 and prevent the pressurized hydraulic fluid from leaking out of the cylinder 52. An annular retainer plate 73 completes the cylinder head 60 and has a surface against which the nuts 76 engage when threaded onto the cylinder head bolts 74. The seal carrier 72 is against the head body 71 and the retainer plate 73 is against the seal retainer. Gaskets may be provided between the head body 71 and the seal carrier 72 and between the seal retainer and the retainer plate 73, nevertheless the head body, seal retainer, and the retainer ring in that case are still considered as being against each other.

The guide bushing 70 has a tubular shape and extends around the outer circumferential surface of the cylinder head body 71. The guide bushing 70 has an inwardly projecting flange 80 that extends into an annular groove 82 in the exterior surface of the cylinder head body 71. The guide bushing abuts a wall of that groove 82 thereby limiting the extent to which the guide bushing 70 is able to slide longitudinally over the outer surface of the body 71, i.e., in the leftward direction in the orientation shown in FIG. 4. An annular bushing retainer 84 also is received within the groove 82 abutting and securing the guide bushing 70 on the body 71. During assembly of the cylinder head 60, the guide bushing 70 and the bushing retainer 84 are initially placed around the body 71. Then the seal carrier 72 is inserted onto the bolts 74 and positioned against the body 71. The seal carrier 72 has an outer diameter that is larger than the diameter of the groove 82 in the body, thereby captivating the bushing retainer 84 and preventing rightward movement of the guide bushing 70 in the illustrated orientation. The retainer plate 73 then is inserted onto the bolts 74 and secured in place by the nuts 76.

The guide bushing 70 may be fabricated of a self-lubricating, fabric reinforced resin material, such as that marketed under the brand name ORKOT 361 by Trelleborg AB of Trelleborg, Sweden. The material of this guide bushing 70 contains a lubricant. Nevertheless, the guide bushing 70 may be made of other suitable materials, for example, various plastics, such as nylon or polytetrafluoroethylene, or metal, such as bronze or brass. Regardless of the material used, the guide bushing 70 may or may not be provided with self lubricating components.

Referring again to FIG. 3, when the crowd assembly 30 is put together, the outer curved surface of the guide bushing 70 contacts the interior surface of the dipper handle 32. This supports the cylinder head 60 within the dipper handle and prevents the cylinder 52 and piston rod 54 from sagging or deflecting due to gravity and other forces acting on the crowd assembly. That support also maintains the piston rod 54 centered within the aperture 69 of the cylinder head 60 so that a substantially equal gap occurs between the interior diameter of the cylinder head and the outer diameter of the piston rod.

This enables a very small gap to be formed which can be tightly sealed by the sealing rings 78. In prior crowd assemblies in which the cylinder head was not supported by a guide bushing 70, a relatively large gap occurred below the piston rod which required a much larger seal and lower operating hydraulic system pressures to be utilized. With a smaller gap in the present structure, a greater operating pressure can be utilized within the rod chamber 68 without the seal rings 78 failing. In addition, centering the piston rod 54 within the aperture 69 also minimizes the possibility of a direct metal to metal contact between the components of the cylinder head 60 and the piston rod 54. This prevents the wear and galling of those sliding surfaces which could also produce seal failure and the consequential failure of the overall cylinder.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A crowd assembly for a power shovel that has a boom, the crowd assembly comprising:

a saddle block adapted for pivotal connection to the boom;

a tubular dipper handle supported by and slideable relative to the saddle block;

a hydraulic actuator having a cylinder and a piston rod that is extendable from one end of the cylinder, one of the cylinder and the piston rod is fixed to the dipper handle and the other of the cylinder and the piston rod is stationary relative to the saddle block, wherein the cylinder and the piston rod are received within the dipper handle thereby enabling the dipper handle to slide longitudinally over the cylinder, and wherein the cylinder includes an annular groove on an exterior surface and adjacent the one end of the cylinder;

a guide bushing affixed to the cylinder adjacent the one end and slideably contacting an interior surface of the dipper handle, wherein the guide bushing includes an inwardly projecting flange extending into the annular groove of the cylinder and abutting a wall of the annular groove to limit longitudinal movement of the guide bushing in a first direction relative to the cylinder; and an annular bushing retainer received within the annular groove of the cylinder and abutting the projecting flange of the guide bushing to limit longitudinal movement of the guide bushing in a second direction relative to the cylinder.

2. The crowd assembly as recited in claim 1 wherein the cylinder comprises a tubular shell having an open end and a head secured to the open end of the shell to form the one end, the head having an aperture through which the piston rod slides to extend from and retract into the cylinder.

3. The crowd assembly as recited in claim 2 wherein the head comprises a body attached to the shell, and a seal carrier located on a side of the body that is remote from the shell and having at least one seal engaging the piston rod.

4. The crowd assembly as recited in claim 3 wherein the head further comprises a retainer plate on a side of the seal carrier that is remote from the body.

5. The crowd assembly as recited in claim 2, wherein the head includes an annular seal carrier that receives the piston rod and at least partially forms the annular groove of the cylinder, wherein the annular seal carrier has an outer diameter that is larger than the diameter of the annular groove and abuts the annular bushing retainer to prevent longitudinal movement of the annular bushing retainer and the guide bushing in the second direction relative to the cylinder.

6. The crowd assembly as recited in claim 5, wherein the head includes a body attached to the shell, wherein the body contacts the annular seal carrier and forms the annular groove of the cylinder in combination with the annular seal carrier.

7. The crowd assembly as recited in claim 6, wherein the body abuts the guide bushing to limit longitudinal movement of the guide bushing in the first direction relative to the cylinder.

8. The crowd assembly as recited in claim 6, wherein the head further includes an annular retainer plate that abuts the annular seal carrier and receives the piston rod, and wherein the annular retainer plate, the body, and the annular seal carrier fit against one another and are coupled by a plurality of fasteners received by each of the annular retainer plate, the body, and the annular seal carrier.

9. The crowd assembly as recited in claim 6, wherein the annular bushing retainer contacts the body at a first end and the annular seal carrier at a second end, extending across the entirety of outer surface of the cylinder within the annular groove.

10. The crowd assembly as recited in claim 9, wherein the projecting flange of the guide bushing extends into the annular groove to contact the annular bushing retainer.

11. The crowd assembly as recited in claim 5, wherein the annular seal carrier has a plurality of grooves extending circumferentially on its interior surface, and wherein a separate sealing ring is received within each of the plurality of grooves to seal a space between the cylinder and the piston rod at the annular seal carrier.

12. The crowd assembly as recited in claim 1 wherein the guide bushing contains a lubricant.

13. The crowd assembly as recited in claim 1 wherein the guide bushing is made of a material selected from the group consisting of a plastic, nylon, bronze, and brass.

14. A crowd assembly for a power shovel that has a boom, the crowd assembly comprising:

a saddle block adapted for pivotal connection to the boom;

a dipper handle supported by the saddle block and being slideable relative to the saddle block between an extended position and retracted position;

a hydraulic actuator having a cylinder and a piston rod extendable outward from one end section of the cylinder, the cylinder being fixed to the saddle block and the piston rod being fixed to the dipper handle, wherein the dipper handle is tubular with the cylinder and the piston rod received therein, thereby enabling the dipper handle to slide longitudinally over the cylinder, and wherein the cylinder includes an annular groove on an exterior surface and adjacent the one end section of the cylinder;

a guide bushing extending around the one end section of the cylinder and engaging an interior surface of the dipper handle, wherein the guide bushing includes an inwardly projecting flange extending into the annular groove of the cylinder and abutting a wall of the annular groove to limit longitudinal movement of the guide bushing in a first direction relative to the cylinder; and an annular bushing retainer received within the annular groove of the cylinder and abutting the projecting flange of the guide bushing to limit longitudinal movement of the guide bushing in a second direction relative to the cylinder.

15. The crowd assembly as recited in claim 14 wherein the cylinder comprises a tubular shell having an open end and a head secured to the open end of the shell to form the one end section, the head having an aperture through which the piston rod is slideably received to move between an extended and a retracted position relative to the cylinder.

16. The crowd assembly as recited in claim 15 wherein the head comprises a body attached to the shell and having an exterior annular groove into which the guide bushing projects, and a seal carrier against the body and having at least one sealing ring engaging the piston rod.

17. The crowd assembly as recited in claim 16 wherein the head further comprises a retainer plate secured against a side of the seal carrier that is remote from the body.

18. The crowd assembly as recited in claim 16 wherein the guide bushing contains a lubricant.

19. The crowd assembly as recited in claim 14 wherein the guide bushing is made of a material selected from the group consisting of a plastic, bronze, and brass.

* * * * *